US011021909B2

(12) United States Patent
Lai

(10) Patent No.: US 11,021,909 B2
(45) Date of Patent: Jun. 1, 2021

(54) SPRING ROLLER BLIND SYSTEM

(71) Applicant: Yung-Ching Lai, Chia Yi County (TW)

(72) Inventor: Yung-Ching Lai, Chia Yi County (TW)

( * ) Notice: Subject to any disclaimer, the term of this patent is extended or adjusted under 35 U.S.C. 154(b) by 281 days.

(21) Appl. No.: 16/243,435

(22) Filed: Jan. 9, 2019

(65) Prior Publication Data

US 2020/0217130 A1 Jul. 9, 2020

(51) Int. Cl.
*E06B 9/42* (2006.01)
*E06B 9/60* (2006.01)

(52) U.S. Cl.
CPC . *E06B 9/42* (2013.01); *E06B 9/60* (2013.01)

(58) Field of Classification Search
CPC ..... E06B 9/40; E06B 9/42; E06B 9/50; E06B 9/56; E06B 9/60; E06B 9/76; E06B 9/88
See application file for complete search history.

(56) References Cited

U.S. PATENT DOCUMENTS 6,230,582 B1 * 5/2001 Becker ..... E04F 10/0614 160/22
2011/0000628 A1 * 1/2011 Anderson ..... E06B 9/30 160/313
2011/0024064 A1 * 2/2011 Ng ..... E06B 9/42 160/317
2012/0061035 A1 * 3/2012 Hsieh ..... E06B 9/88 160/293.1
2014/0069596 A1 * 3/2014 Ng ..... E06B 9/90 160/305
2018/0252033 A1 * 9/2018 Bohlen ..... F16H 21/44

FOREIGN PATENT DOCUMENTS

AU 2017100436 A4 * 5/2017

* cited by examiner

*Primary Examiner* — Daniel P Cahn
*Assistant Examiner* — Matthew R. Shepherd
(74) *Attorney, Agent, or Firm* — Daniel J. Santos, Esq.; Thomas Horstemeyer, LLP

(57) ABSTRACT

A spring roller blind system is provided that has a roller blind module, a height adjusting module, a winding module, a first main adjusting device disposed on the height adjusting module, a second main adjusting device disposed on the winding module, an auxiliary adjusting element, and a fixing element. The height adjusting module and the winding module are respectively disposed on two ends of the roller blind module. The auxiliary adjusting element is selectively and detachably disposed on a first main adjusting element of the first main adjusting device or a second main adjusting element of the second main adjusting device for adjusting the height adjusting module or the winding module. The fixing element is selectively inserted into a fixing recess of the winding module for positioning the second main adjusting element.

16 Claims, 13 Drawing Sheets

SPRING ROLLER BLIND SYSTEM

BACKGROUND OF THE INVENTION

1. Field of the Invention

The present invention relates to a spring roller blind system, and more particularly a spring roller blind system that may be convenient in adjustment

2. Description of Related Art

A conventional spring roller blind system has a roller blind module, a height adjusting module, a winding module, and two main adjusting devices. The roller blind module has a roller tube and a blind. The roller tube has a first end and a second end opposite to the first end of the roller blind. The blind is retractably wound on the roller tube. The height adjusting module is inserted into the first end of the roller tube and has a height-adjusting head inserted into the first end of the roller tube. The winding module is inserted into the second end of the roller tube and has a winding-adjusting head. The two main adjusting devices are respectively inserted into the height-adjusting head of the height adjusting module and the winding-adjusting head of the winding module.

Each main adjusting device has a bracket and an adjusting element. The adjusting element is detachably disposed on the bracket, wherein the two adjusting elements of the main adjusting devices are respectively inserted into the height adjusting module and the winding module. The adjusting element has a shell, an adjusting member, and an adjusting shaft. The shell is detachably disposed on the bracket and has a side surface. The adjusting member is rotatably disposed in the shell. The adjusting shaft is disposed in the shell, is connected to the adjusting member, and has a slot. The slot is formed in an end surface of the adjusting shaft to be exposed out of the side surface of the shell.

To adjust a position of a bottom edge of the blind, a hand tool operated by users may be inserted into the slot of one of the adjusting shafts for adjusting the height adjusting module.

To adjust a retracting speed of the blind, the hand tool may be inserted into the slot of the other adjusting shaft for adjusting the winding module.

However, in each main adjusting device, the slot is formed in the end surface of the adjusting shaft and is exposed out of the side surface of the shell. The rotation of the adjusting shaft is driven by the hand tool. An outer diameter of the adjusting shaft is small. A rotating axis of the adjusting shaft is perpendicular to a rotating axis of the adjusting member. The adjusting shaft has to rotate multiple circles for driving the adjusting member to rotate to adjust the height adjusting module or the winding module. The adjustments of the height adjusting module and the winding module are inconvenient and time-consuming.

To overcome the shortcomings, the present invention tends to provide a spring roller blind system to mitigate or obviate the aforementioned problems.

SUMMARY OF THE INVENTION

The main objective of the invention is to provide a spring roller blind system that may solve the problem that the adjustments of the height adjusting module and the winding module by the main adjusting devices are inconvenient and time-consuming.

The spring roller blind system has a roller blind module, a height adjusting module, a winding module, a first main adjusting device, a second main adjusting device, an auxiliary adjusting element, and a fixing element.

The roller blind module has a roller tube and a blind. The roller tube is hollow and has an outer surface, a first end, and a second end opposite the first end of the roller tube. The blind is retractably wound on the outer surface of the roller tube and has a top edge fixed on the outer surface of the roller tube.

The height adjusting module is inserted into the first end of the roller tube and has a height-adjusting head. The height-adjusting head is inserted into the first end of the roller tube and has an outer end surface and a height-adjusting hole. The outer end surface of the height-adjusting head is exposed out of the roller tube. The height-adjusting hole is formed in the height-adjusting head and extends to the outer end surface of the height-adjusting head.

The winding module is inserted into the second end of the roller tube and has a winding-adjusting head and a fixing recess. The winding-adjusting head is inserted into the second end of the roller tube and has an outer end surface exposed out of the roller tube. The fixing recess is formed on the outer end surface of the winding-adjusting head.

The first main adjusting device is inserted into the height-adjusting head of the height adjusting module and has a first bracket and a first main adjusting element. The first bracket is located outside the first end of the roller tube. The first main adjusting element is detachably disposed on the first bracket and is inserted into the height-adjusting hole of the height-adjusting head.

The second main adjusting device is inserted into the winding-adjusting head of the winding module and has a second bracket and a second main adjusting element. The second bracket is located outside the second end of the roller tube. The second main adjusting element is detachably disposed on the second bracket and is connected to the winding-adjusting head.

The auxiliary adjusting element is selectively and detachably disposed on the first main adjusting element or the second main adjusting element, and has a base, an engaging member, and a handle. The base has a first surface, a second surface, a first end, and a second end. The second surface of the base is opposite to the first surface of the base. The second end of the base is opposite to the first end of the base. The engaging member is formed on the first surface of the base adjacent to the first end of the base. The handle is formed on the second surface of the base adjacent to the second end of the base.

The fixing element is selectively inserted into the fixing recess of the winding module for positioning the second main adjusting element.

In use, the first bracket and the second bracket are disposed on a wall or a ceiling. The height adjusting module and the winding module are disposed on the roller tube of the roller blind module. The first main adjusting element of the first main adjusting device is disposed on the height-adjusting head. The second main adjusting element of the second main adjusting device is disposed on the winding-adjusting head of the winding module.

In adjustment, the auxiliary adjusting element engages with the second main adjusting element. The second main adjusting element can be rotated by the auxiliary adjusting element for adjusting the torsion of the winding module. After finishing the torsion adjustment of the winding module, the fixing element can be inserted into the fixing recess for preventing the second main adjusting element from rotating. The auxiliary adjusting element can be detached from the second main adjusting element. The second main adjusting element can be disposed on the second bracket. The fixing element can be detached from the fixing recess. In addition, the auxiliary adjusting element engages with the first main adjusting element. The second main adjusting element can be rotated by the auxiliary adjusting element for adjusting the position of a bottom edge of the blind. After finishing the adjustment of the height adjusting module, the auxiliary adjusting element can be detached from the first main adjusting element. The first main adjusting element can be disposed on the first bracket.

Accordingly, a rotating axis of the auxiliary adjusting element and a rotating axis of the first main adjusting element are the same. The number of turns of the auxiliary adjusting element is the same as the number of turns of the first main adjusting element. The auxiliary adjusting element is easy in operation. The adjustment of the height adjusting module is convenient and saves time. By the same token, the adjustment of the winding module is convenient and saves time. Furthermore, the fixing element can position the second main adjusting element after adjustment for increasing the adjusting convenience of the winding module.

Other objects, advantages and novel features of the invention will become more apparent from the following detailed description when taken in conjunction with the accompanying drawings.

DETAILED DESCRIPTION OF PREFERRED EMBODIMENT

Figure 1:
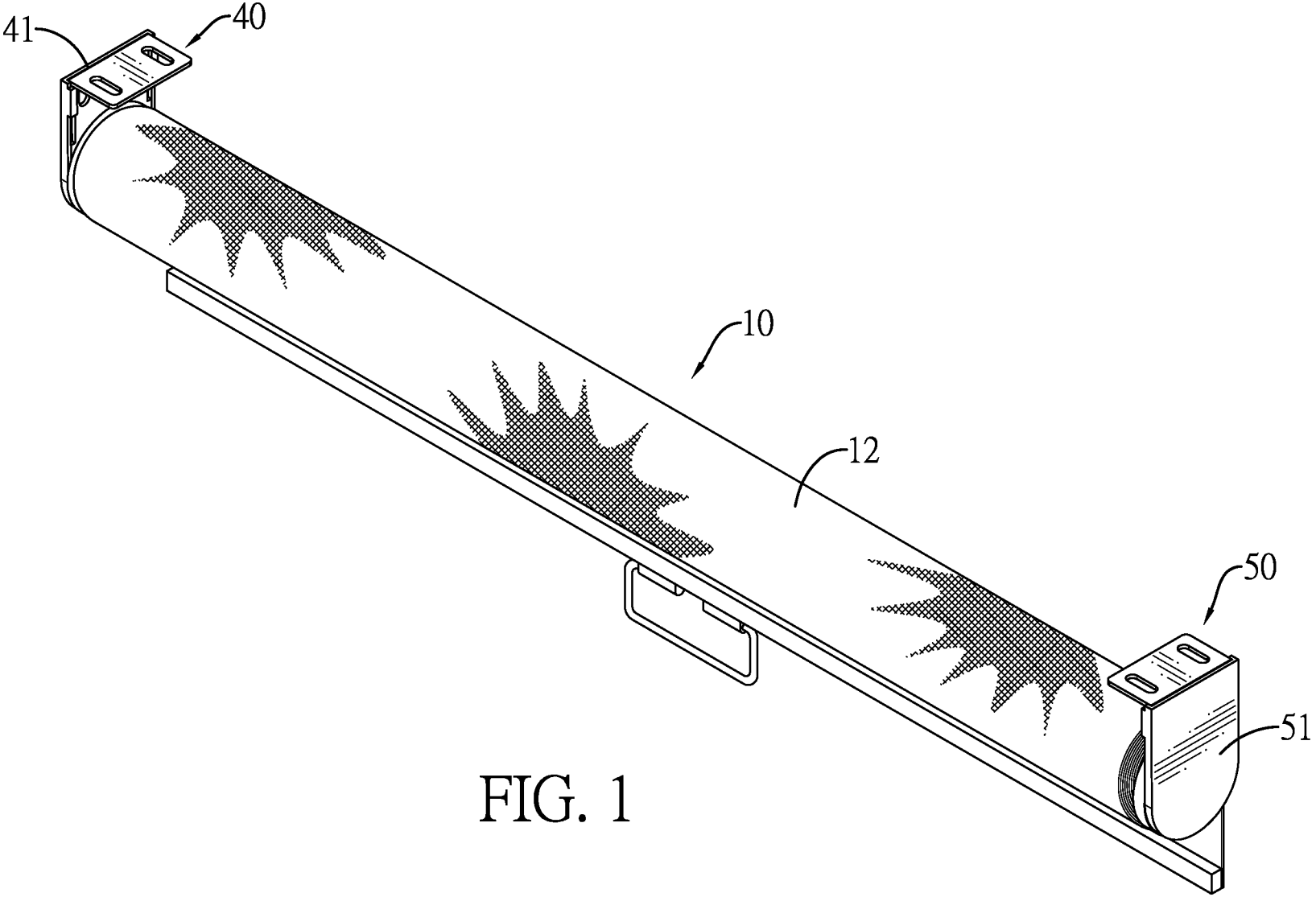
FIG. 1 is a perspective view of a spring roller blind system in accordance with a preferred embodiment of the present disclosure, showing a roller blind module is disposed between a first main adjusting device and a second main adjusting device.

In the following detailed description, for purposes of explanation and not limitation, an example embodiment disclosing specific details is set forth in order to provide a thorough understanding of the inventive principles and concepts. However, it will be apparent to one having ordinary skill in the art having the benefit of the present disclosure that other embodiments according to the present teachings that depart from the specific details disclosed herein remain within the scope of the appended claims. Moreover, descriptions of well-known apparatuses and methods may be omitted so as to not obscure the description of the preferred embodiment. Such methods and apparatuses are clearly within the scope of the present disclosure.

Relative terms may be used to describe the various elements' relationships to one another, as illustrated in the accompanying drawings. These relative terms are intended to encompass different orientations of the device and/or elements in addition to the orientation depicted in the drawings.

With reference to FIGS. 1 to 4, a spring roller blind system in accordance with the present invention comprises a roller blind module 10, a height adjusting module 20, a winding module 30, a first main adjusting device 40, a second main adjusting device 50, an auxiliary adjusting element 60, and a fixing element 70.

The roller blind module 10 has a roller tube 11 and a blind 12. The roller tube 11 is hollow and has an outer surface, a first end, and a second end opposite the first end of the roller tube 11. The blind 12 is retractably wound on the outer surface of the roller tube 11 and has a top edge fixed on the outer surface of the roller tube 11.

The height adjusting module 20 is inserted into the first end of the roller tube 11 and has a height-adjusting head 21. The height-adjusting head 21 is inserted into the first end of the roller tube 11 and has an outer end surface and a height-adjusting hole 22. The outer end surface of the height-adjusting head 21 is exposed out of the roller tube 11. The height-adjusting hole 22 is formed in the height-adjusting head 21 and extends to the outer end surface of the height-adjusting head 21.

The winding module 30 is inserted into the second end of the roller tube 11 and has a winding-adjusting head 31 and a fixing recess 32. The winding-adjusting head 31 is inserted into the second end of the roller tube 11 and has an outer end surface exposed out of the roller tube 11. The fixing recess 32 is formed on the outer end surface of the winding-adjusting head 31.

Figure 2:
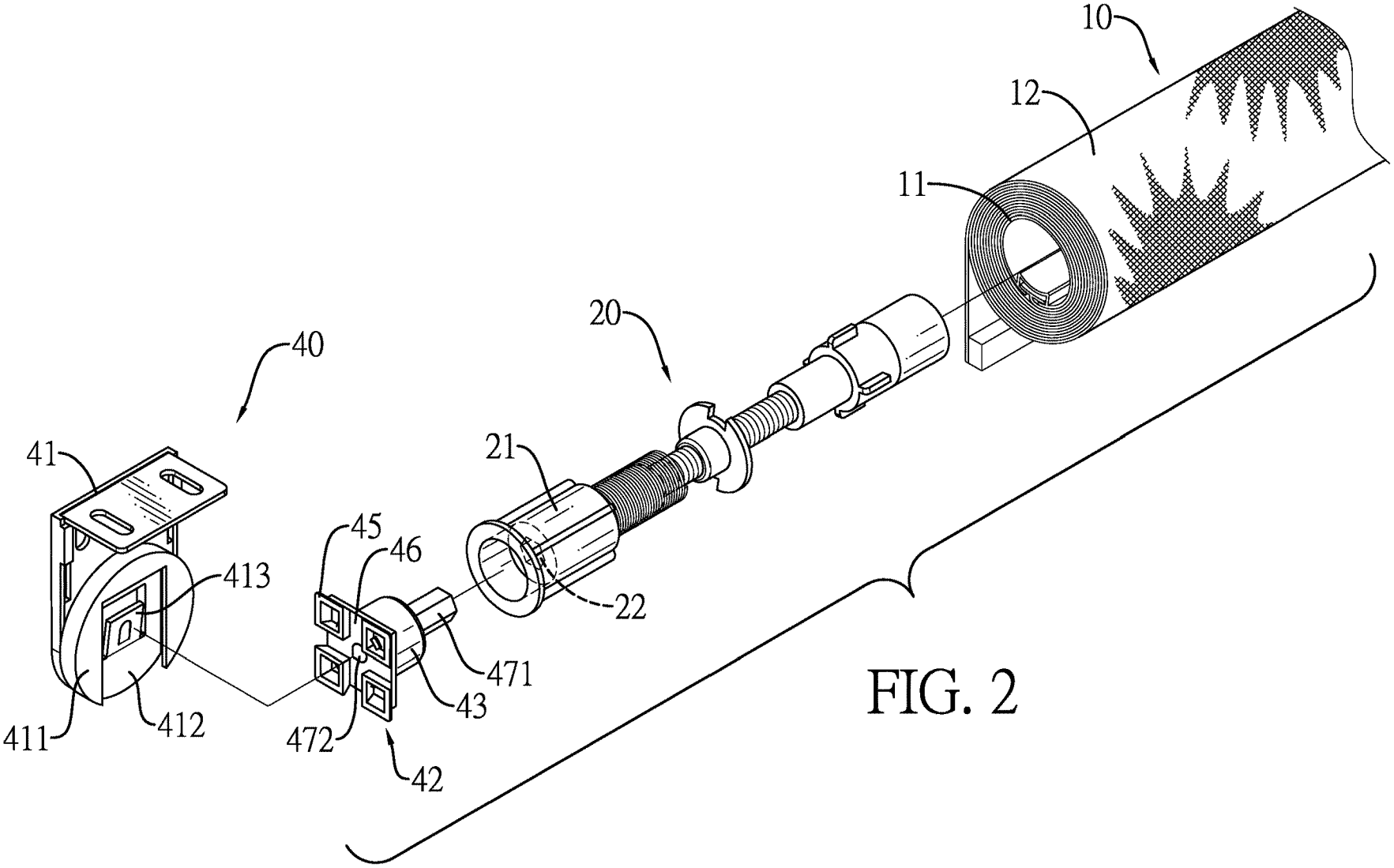
FIG. 2 is an exploded perspective view of the spring roller blind system in FIG. 1, showing a height adjusting module is disposed in the roller blind module and is connected to the first main adjusting device.
Figure 7:
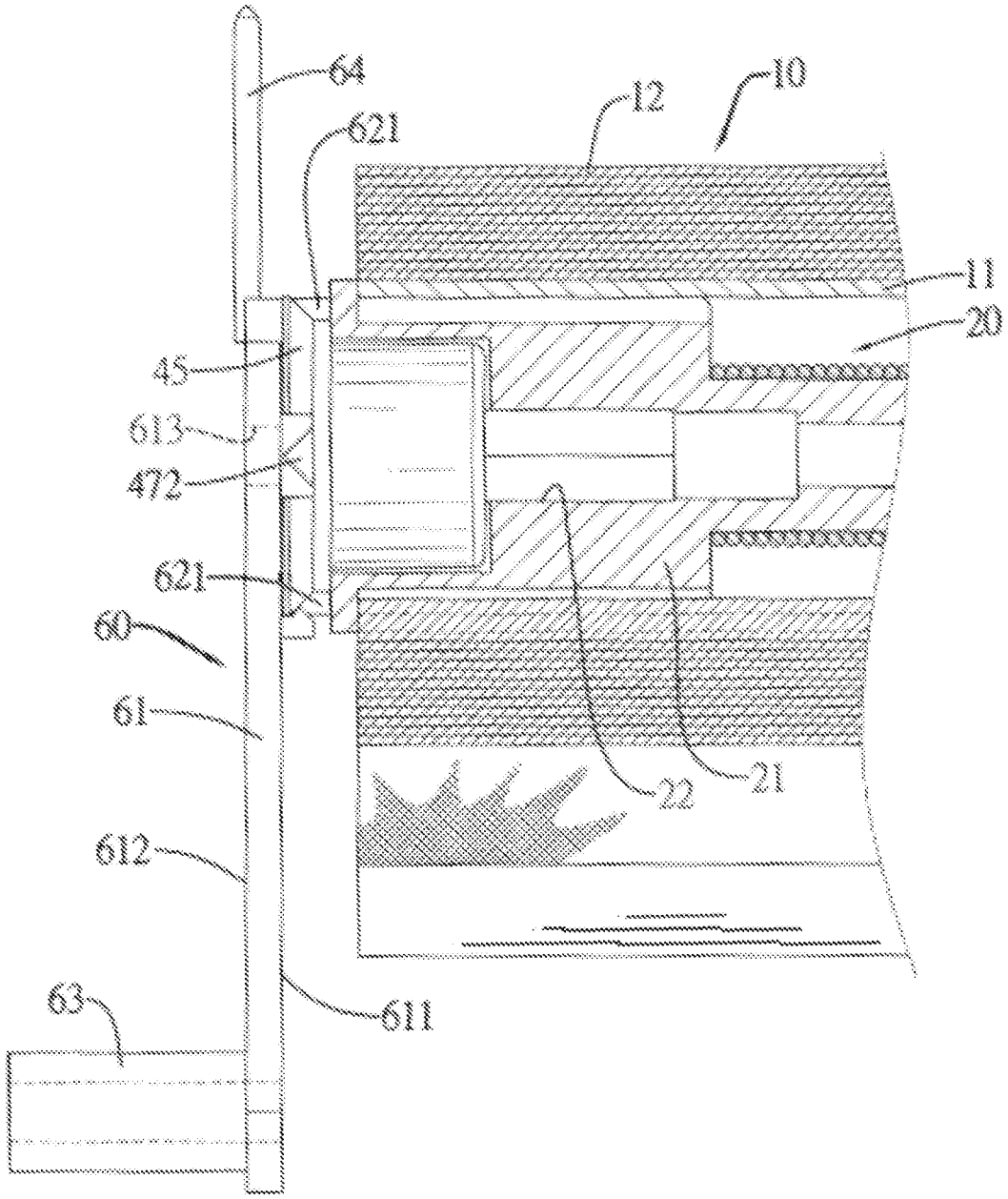
FIG. 7 is an enlarged side view in partial section of the spring roller blind system in FIG. 1, showing the auxiliary adjusting element engages with a first main adjusting element of the first main adjusting device.
Figure 9:
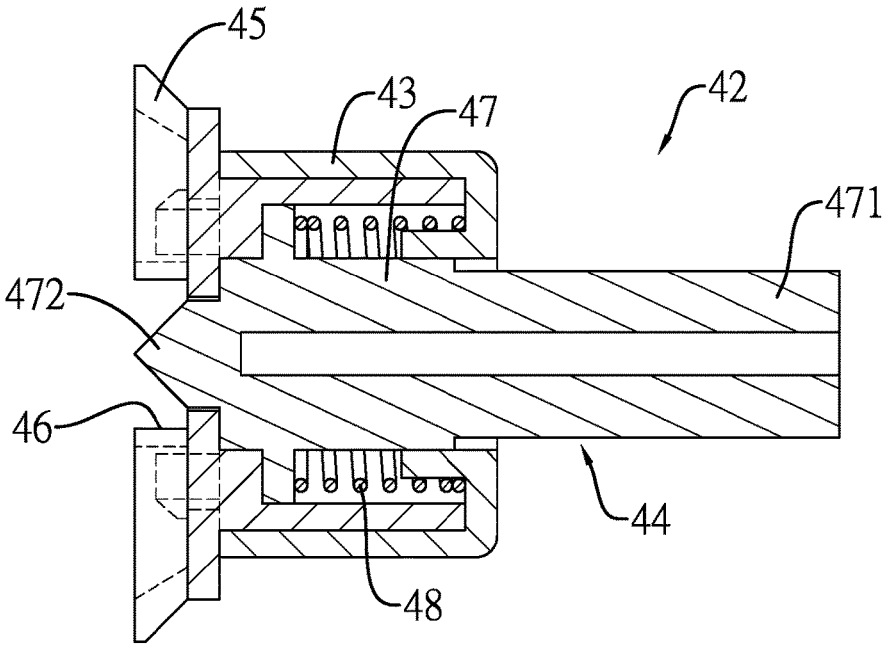
FIG. 9 is a cross sectional side view of the first main adjusting element of the spring roller blind system in FIG. 2.

With reference to FIGS. 2, 7, and 9, the first main adjusting device 40 is inserted into the height-adjusting head 21 of the height adjusting module 20 and has a first bracket 41 and a first main adjusting element 42. The first bracket 41 is located outside the first end of the roller tube 11. The first main adjusting element 42 is detachably disposed on the first bracket 41 and is inserted into the height-adjusting hole 22 of the height-adjusting head 21.

Figure 3:
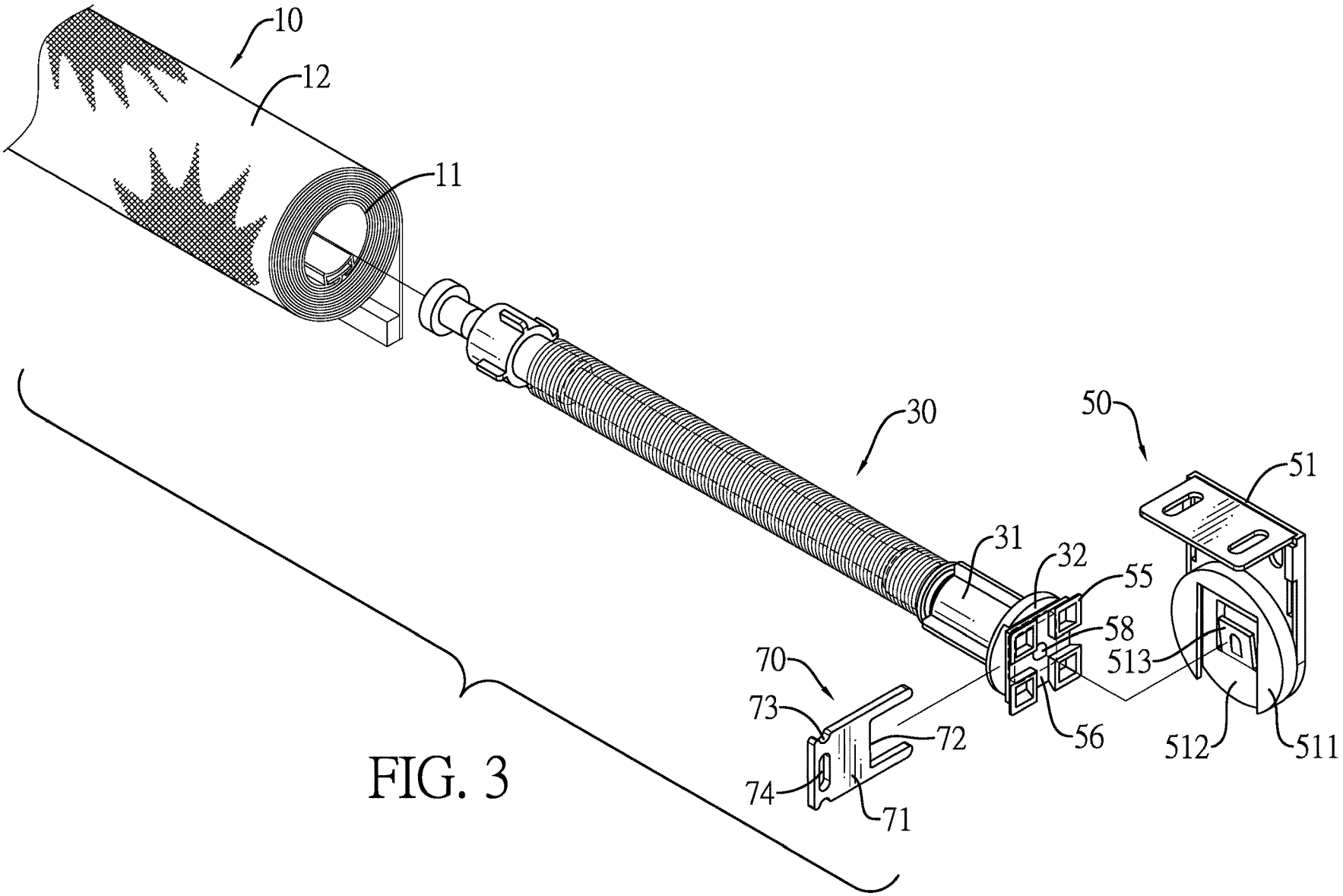
FIG. 3 is another exploded perspective view of the spring roller blind system in FIG. 1, showing a winding module is disposed in the roller blind module and is connected to the second main adjusting device, and a fixing element is inserted between the winding module and second main adjusting device.
Figure 10:
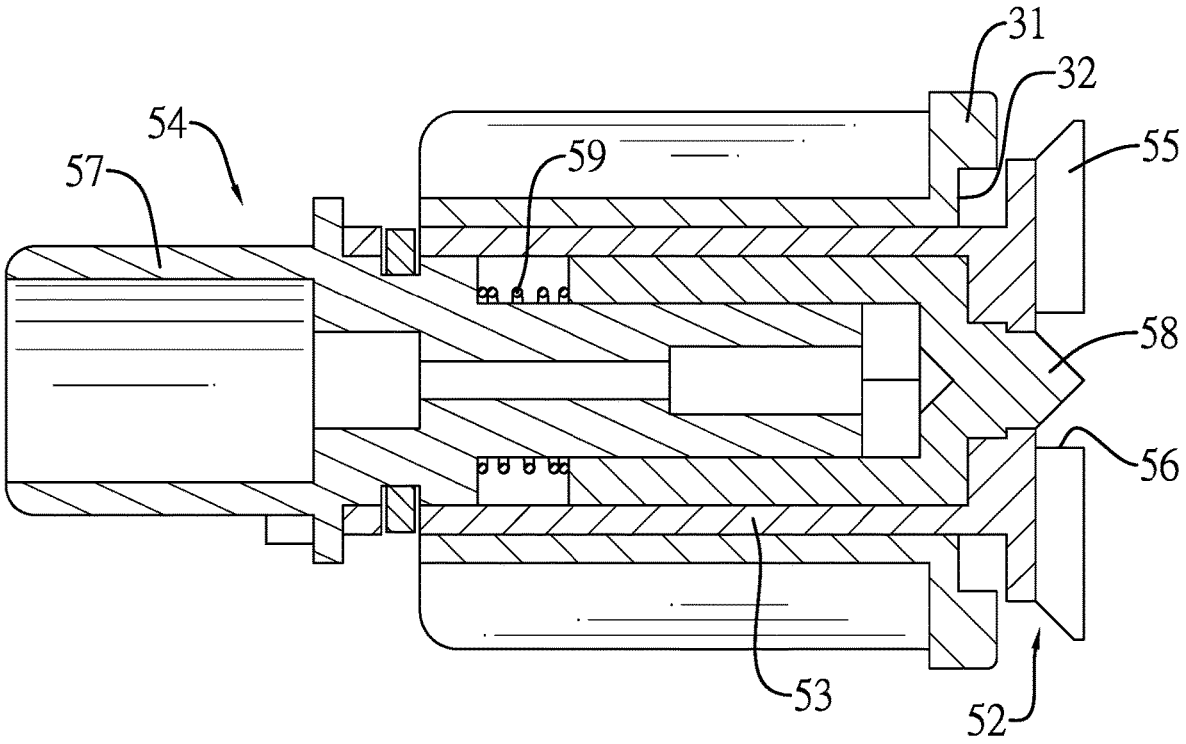
FIG. 10 is a cross sectional side view of the second main adjusting element of the spring roller blind system in FIG. 3.
Figure 13:
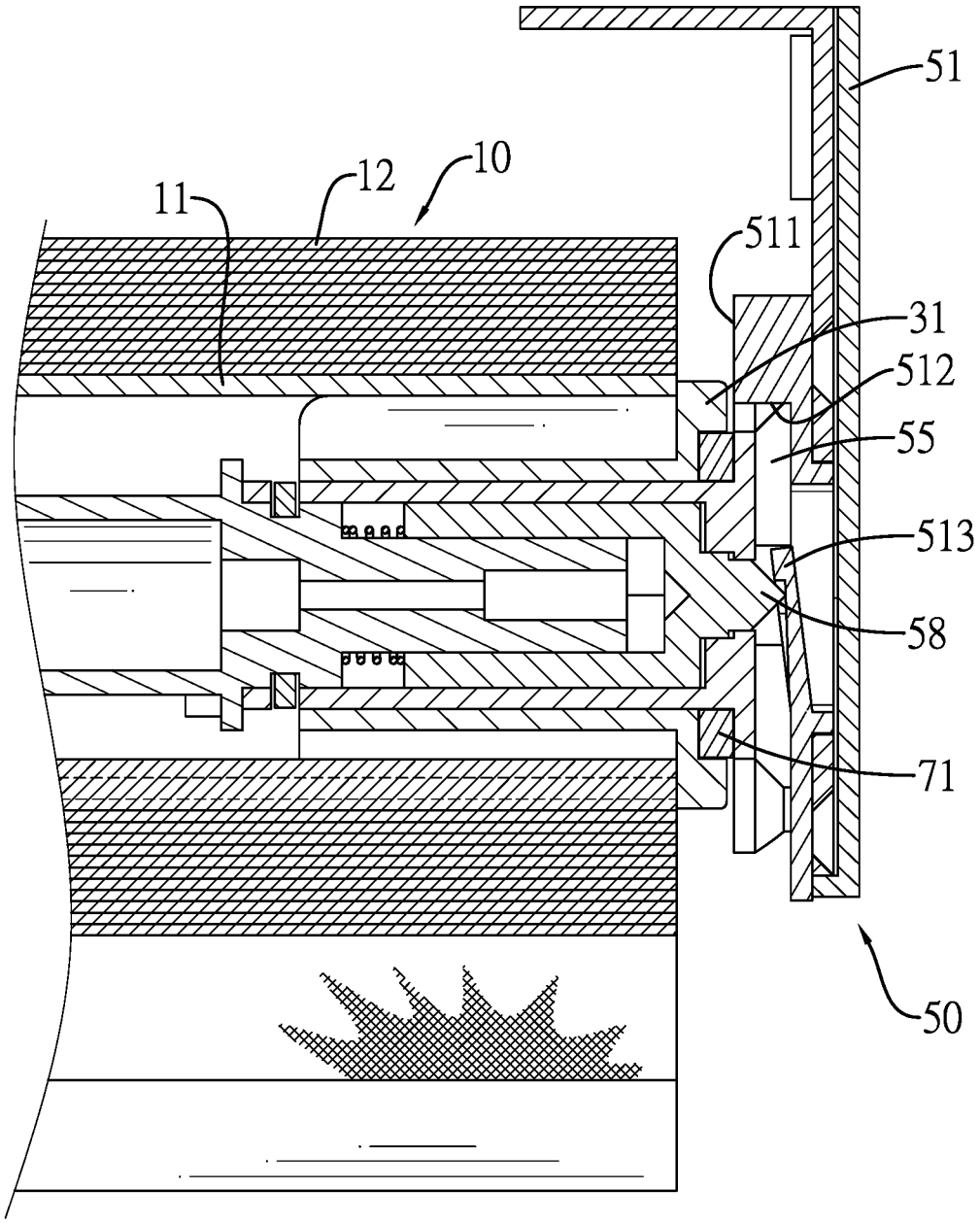
FIG. 13 is an enlarged cross section side view of the second main adjusting device in FIG. 3, showing the fixing element is detached.

With reference to FIGS. 3, 10, and 13, the second main adjusting device 50 is inserted into the winding-adjusting head 31 of the winding module 30 and has a second bracket 51 and a second main adjusting element 52. The second bracket 51 is located outside the second end of the roller tube 11. The second main adjusting element 52 is detachably disposed on the second bracket 51 and is connected to the winding-adjusting head 31.

Figure 4:
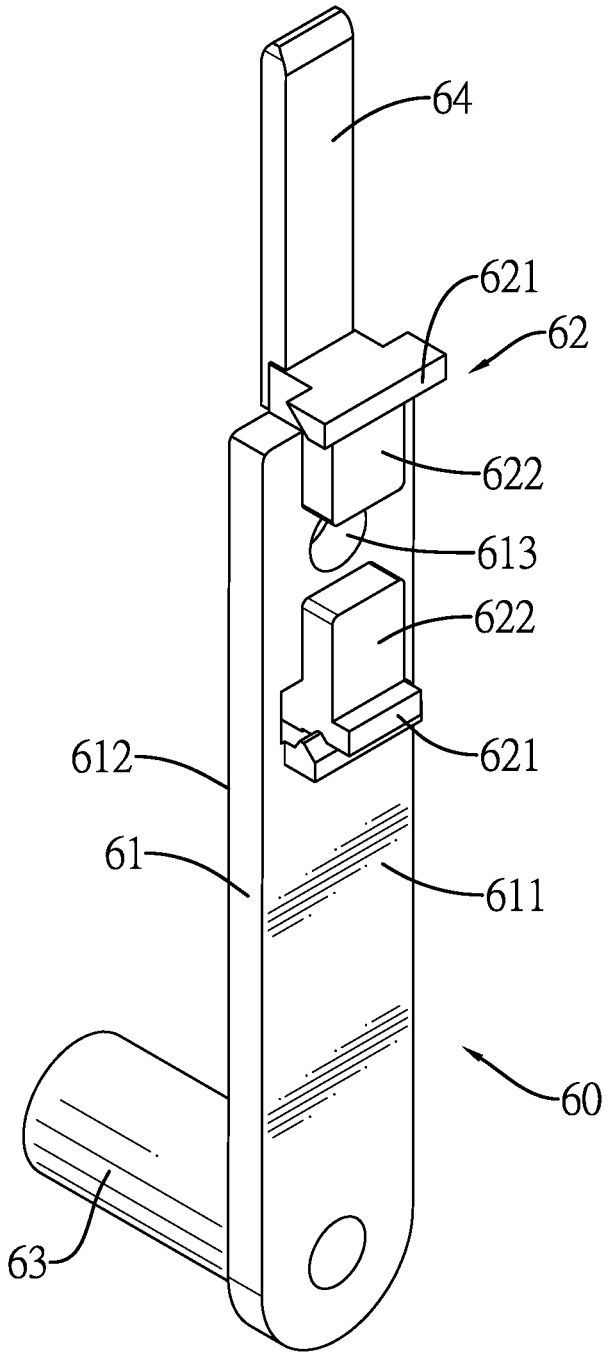
FIG. 4 is a perspective view of an auxiliary adjusting element of the spring roller blind system in FIG. 1.
Figure 5:
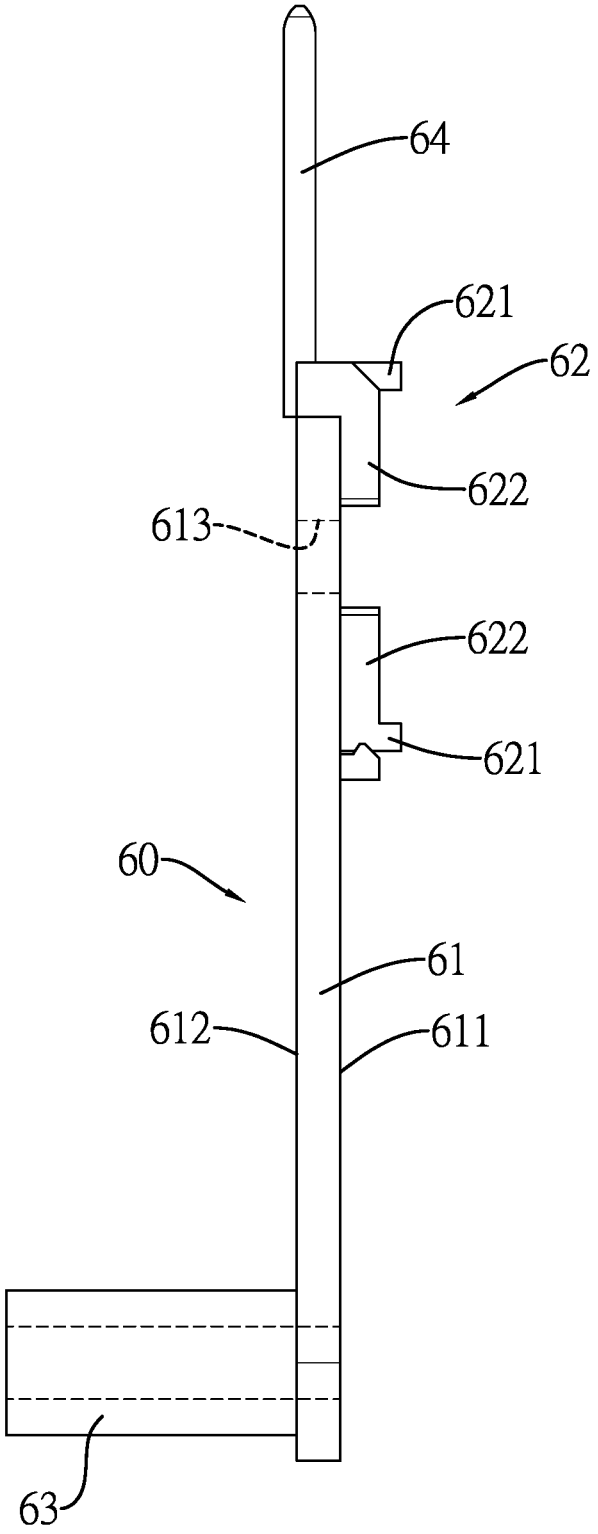
FIG. 5 is a side view of the auxiliary adjusting element of the spring roller blind system in FIG. 4.
Figure 6:
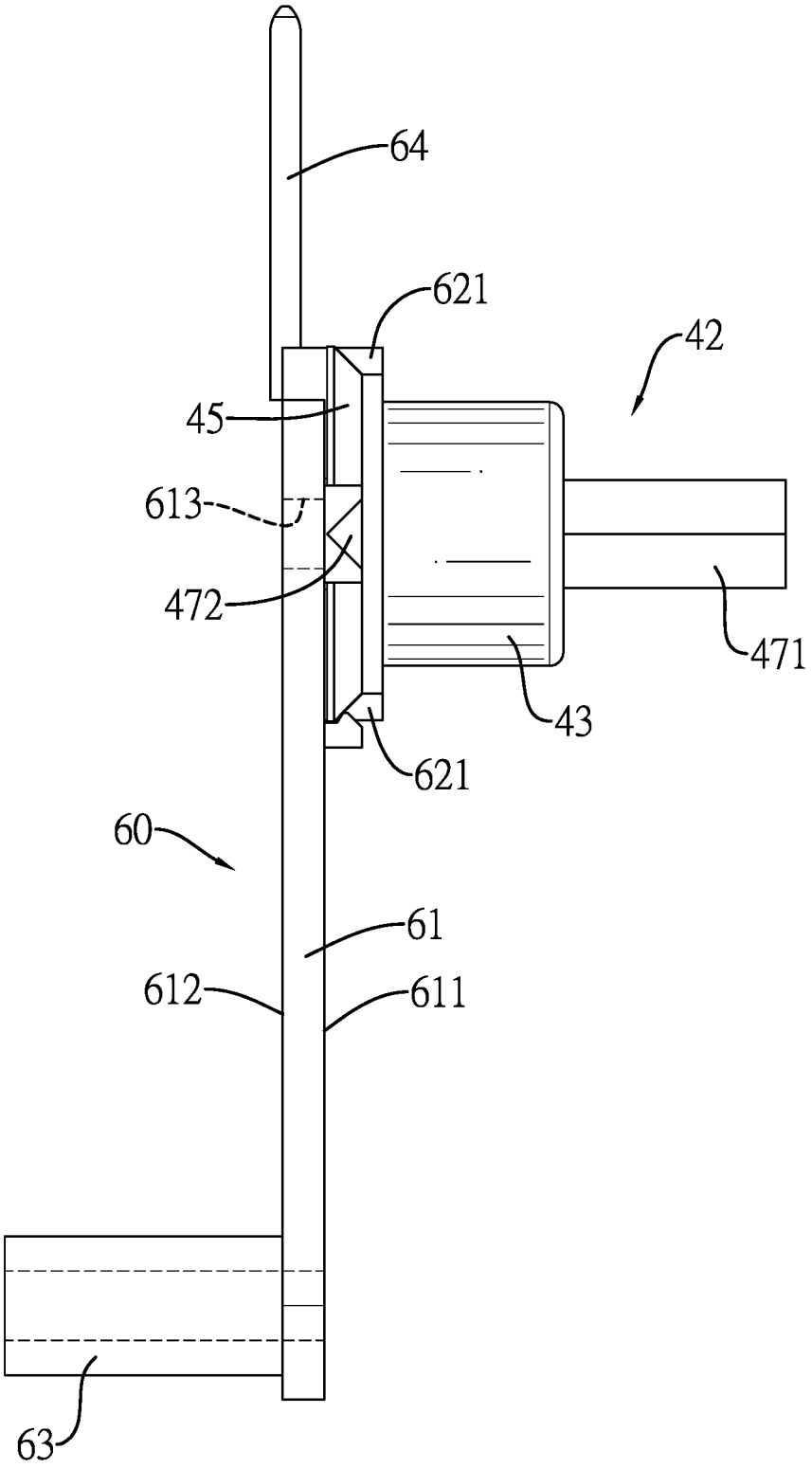
FIG. 6 is a side view of the auxiliary adjusting element of the spring roller blind system in FIG. 4, showing the auxiliary adjusting element engages with a first main adjusting element of the first main adjusting device.
Figure 8:
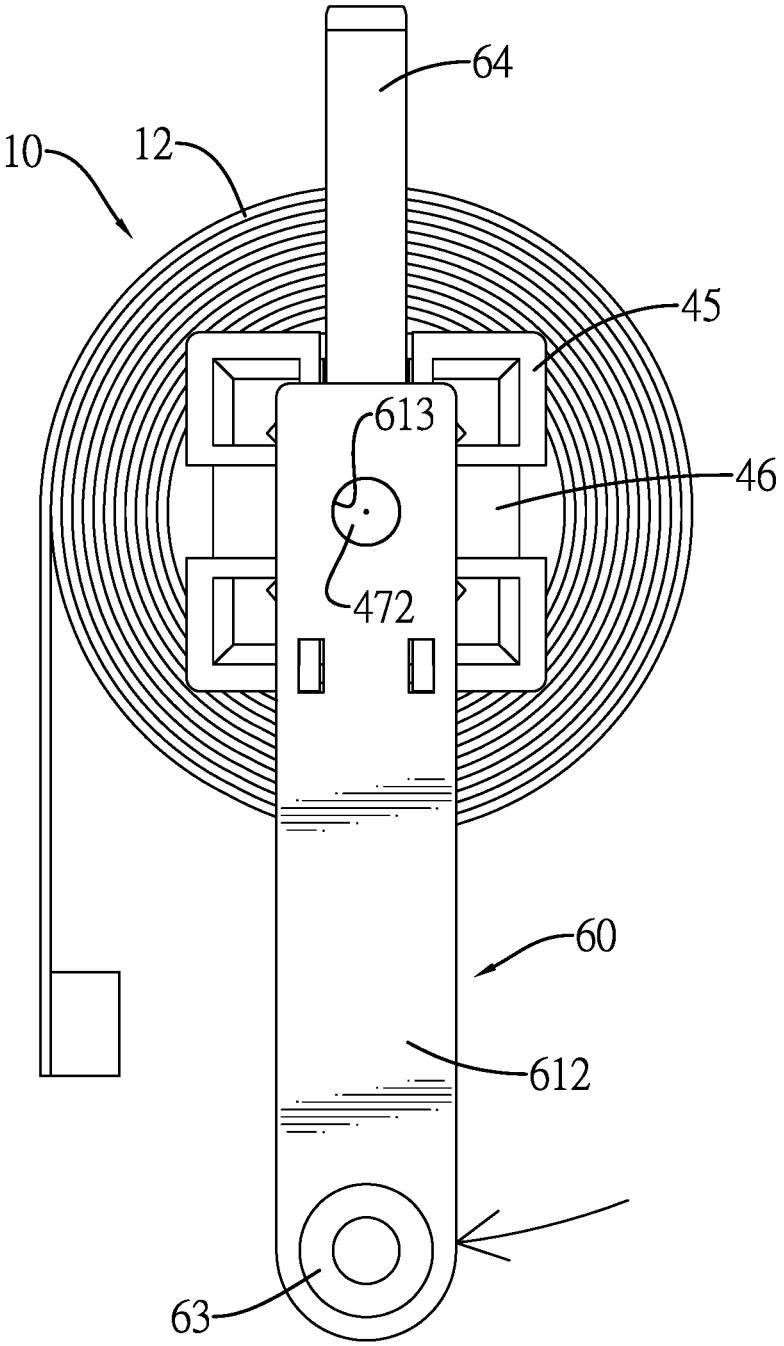
FIG. 8 is an operational end view of the spring roller blind system in FIG. 7.

With reference to FIGS. 6 to 8, the auxiliary adjusting element 60 is selectively and detachably disposed on the first main adjusting element 42 or the second main adjusting element 52. With reference to FIGS. 4 and 5, the auxiliary adjusting element 60 has a base 61, an engaging member 62, and a handle 63. The base 61 has a first surface 611, a second surface 612, a first end, and a second end. In use, the first surface 611 of the base 61 faces the first main adjusting element 42 or the second main adjusting element 52. The second surface 612 is opposite to the first surface 611 of the base 61. The second end of the base 61 is opposite to the first end of the base 61. The engaging member 62 is formed on the first surface 611 of the base 61 adjacent to the first end of the base 61. The handle 63 is formed on the second surface 612 of the base 61 adjacent to the second end of the base 61. Furthermore, the auxiliary adjusting element 60 has an inserting portion 64 formed on the first end of the base 61.

In addition, the engaging member 62 of the auxiliary adjusting element 60 has two engaging portions 621 and two positioning portions 622. The two engaging portions 621 are formed on the first surface 611 of the base 61 at a spaced interval. The two positioning portions 622 are formed on the first surface 611 of the base 61 at a spaced interval and are respectively connected to the two engaging portions 621. Moreover, the base 61 of the auxiliary adjusting element 60 has a through hole 613. The through hole 613 is formed on the first surface 611 of the base 61 and is located between the two engaging portions 621.

Figure 11:
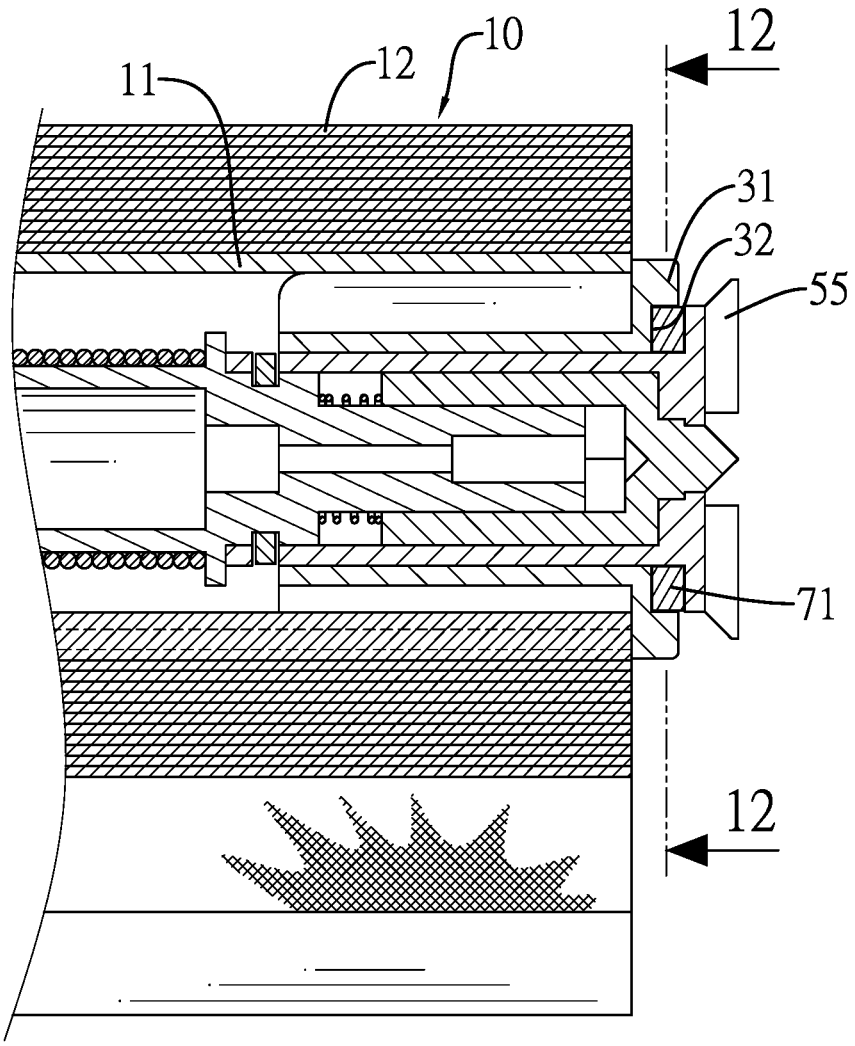
FIG. 11 is an operational cross sectional side view of the fixing element of the spring roller blind system in FIG. 3.
Figure 12:
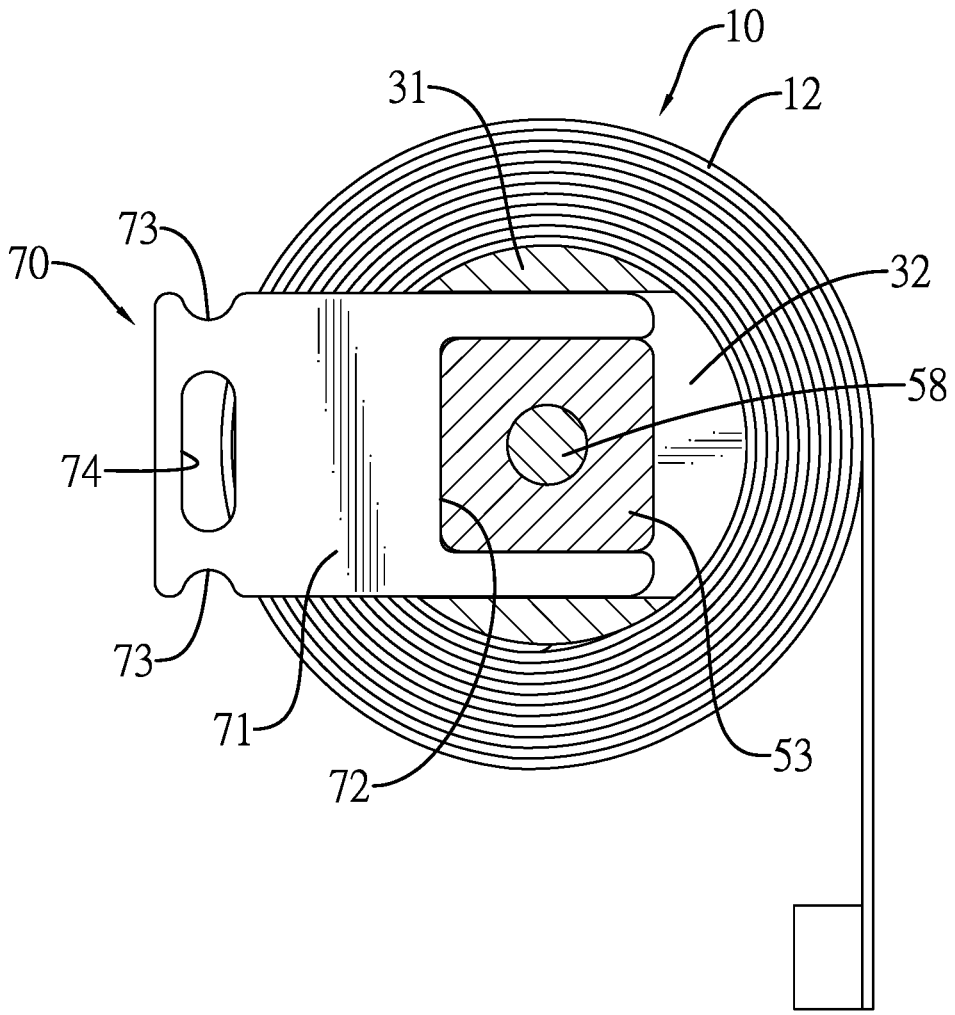
FIG. 12 is a side view in partial section of the fixing element of the spring roller blind system along line 12-12 in FIG. 11.

With reference to FIGS. 3, 11, and 12, the fixing element 70 is selectively inserted into the fixing recess 32 of the winding module 30 for positioning the second main adjusting element 52. Furthermore, the fixing element 70 has a plate 71, an end notch 72, two side notches 73, and an elongated hole 74. The end notch 72 is formed on an end of the plate 71. The two side notches 73 are respectively formed on two side surfaces of the plate 71. The elongated hole 74 is formed through the plate 71, is opposite to the end notch 72, and is located between the two side notches 73. In addition, the auxiliary adjusting element 60 and the fixing element 70 are made of plastic materials.

With reference to FIGS. 2, 7, and 9, the first bracket 41 has a first combining surface 411, a first connecting groove 412, and a first elastic sheet 413. The first combining surface 411 faces the first end of the roller tube 11. The first connecting groove 412 is formed in the first combining surface 411 of the first bracket 41. The first elastic sheet 413 is formed on and protrudes from the first combining surface 411 of the first bracket 41, and is inserted into the first connecting groove 412 of the first bracket 41.

The first main adjusting element 42 has a first shell 43, a first adjusting assembly 44, and a first spring 48. The first shell 43 is detachably inserted into the first connecting groove 412 of the first bracket 41 and has a front surface, a rear surface, an outer edge, multiple first dovetailed portions 45, and a first crisscross groove 46. The front surface of the first shell 43 faces the height-adjusting head 21. The rear surface of the first shell 43 is opposite the front surface of the first shell 43 and abuts against the first elastic sheet 413 of the first bracket 41. The outer edge of the first shell 43 is formed around the rear surface of the first shell 43. The first dovetailed portions 45 are formed on the outer edge of the first shell 43 at spaced intervals. The first crisscross groove 46 is formed on the rear surface of the first shell 43.

The first adjusting assembly 44 is rotatably disposed in the first shell 43 and has a first adjusting rod 47 and a first spring 48. The first adjusting rod 47 is disposed in the first shell 43 and has two ends, a first projection 471, and a first clutch protrusion 472. The first projection 471 is formed on one of the two ends of the first adjusting rod 47 and extends out of the front surface of the first shell 43. The first clutch protrusion 472 is formed on the other one of the two ends of the first adjusting rod 47, is inserted into the first crisscross groove 46 of the first shell 43, and abuts against the first elastic sheet 413 of the first bracket 41. Furthermore, the first projection 471 has an end surface being noncircular.

The first spring 48 is disposed in the first shell 43 and has two ends respectively abutting against the first shell 43 and the first adjusting rod 47.

With reference to FIGS. 3, 10, 11, and 13, the second bracket 51 has a second combining surface 511, a second connecting groove 512, and a second elastic sheet 513. The second combining surface 511 faces the second end of the roller tube 11. The second connecting groove 512 is formed in the second combining surface 511 of the second bracket 51. The second elastic sheet 513 is formed on and protrudes from the second combining surface 511 of the second bracket 51, and is inserted into the second connecting groove 512 of the second bracket 51.

The second main adjusting element 52 has a second shell 53 and a second adjusting assembly 54. The second shell 53 is detachably inserted into the second connecting groove 512 of the second bracket 51 and has a front surface, a rear surface, an outer edge, multiple second dovetailed portions 55, and a second crisscross groove 56. The front surface of the second shell 53 faces the winding-adjusting head 31. The rear surface of the second shell 53 is opposite to the front surface of the second shell 53 and abuts against the second elastic sheet 513 of the second bracket 51. The outer edge of the second shell 53 is formed around the rear surface of the second shell 53. The second dovetailed portions 55 are formed on the outer edge of the second shell 53 at spaced intervals. The second crisscross groove 56 is formed on the rear surface of the second shell 53.

The second adjusting assembly 54 is rotatably disposed in the second shell 53 and has a second projection 57, a second clutch protrusion 58, and a second spring 59. The second projection 57 is disposed in the second shell 53, extends out of the front surface of the second shell 53, and is fixed on the winding-adjusting head 31. The second clutch protrusion 58 is disposed in the second shell 53 around the second projection 57, is inserted into the second crisscross groove 56 of the second shell 53, and abuts against the second elastic sheet 513 of the second bracket 51. The second spring 59 is disposed in the second shell 53 and has two ends respectively abutting against the second projection 57 and the second clutch protrusion 58.

In use, the first bracket 41 and the second bracket 51 are disposed on a wall or a ceiling at a spaced interval. The height adjusting module 20 is inserted into the roller tube 11 of the roller blind module 10 via the first end of the roller tube 11. The winding module 30 is inserted into the roller tube 11 of the roller blind module 10 via the second end of the roller tube 11. The first main adjusting element 42 of the first main adjusting device 40 is disposed on the height-adjusting head 21. The first main adjusting element 42 of the first main adjusting device 40 is inserted into the first connecting groove 412 of the first bracket 41. The first elastic sheet 413 of the first bracket 41 abuts against the first shell 43 for positioning the first main adjusting element 42. The second main adjusting element 52 of the second main adjusting device 50 is inserted into and fixed on the winding-adjusting head 31 of the winding module 30. The second main adjusting element 52 is inserted into the second connecting groove 512 of the second bracket 51. The second elastic sheet 513 of the second bracket 51 abuts against the second shell 53 for positioning the second main adjusting element 52.

Figure 14:
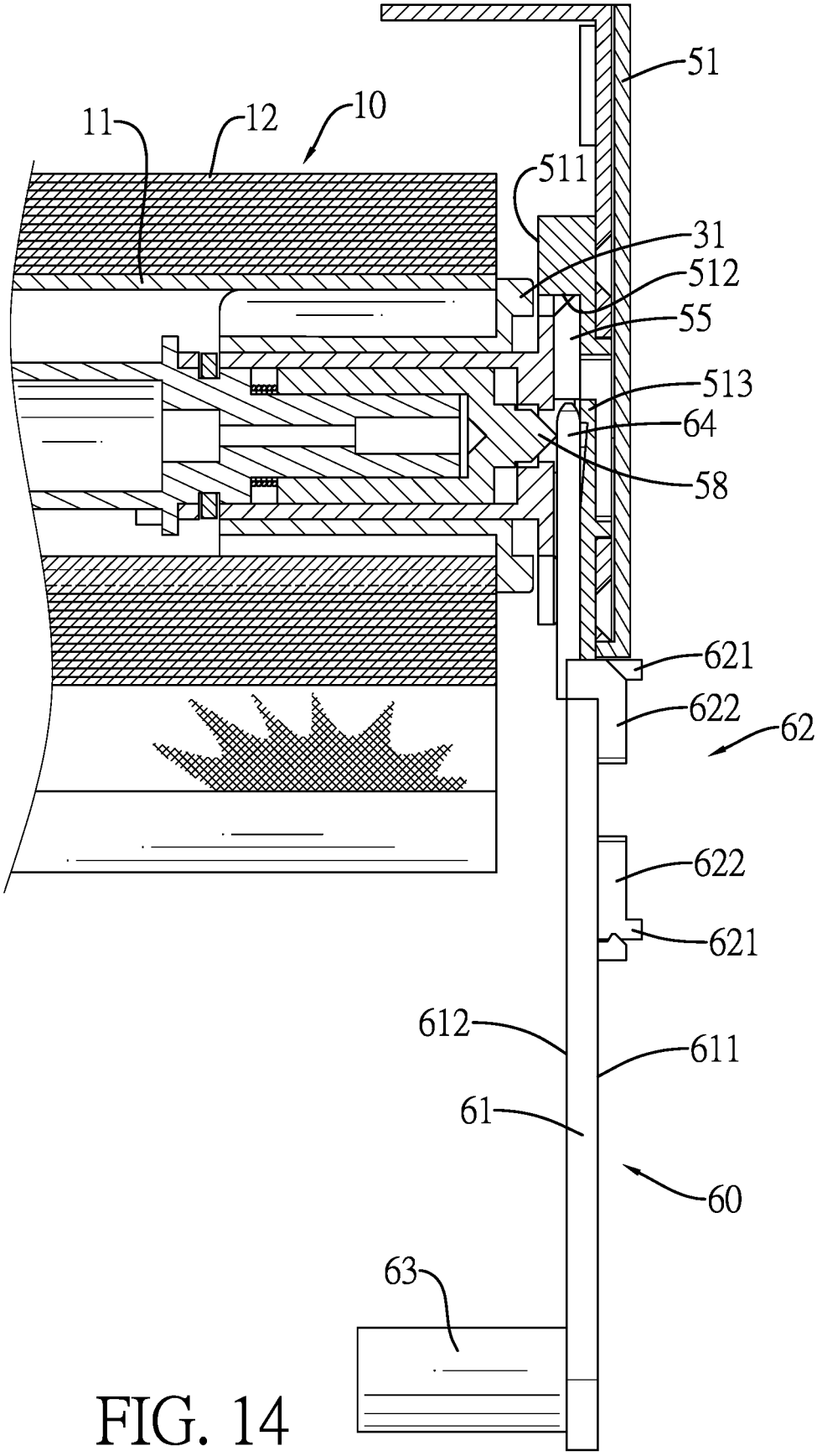
FIG. 14 is an operational cross section side view of the second main adjusting device in FIG. 13, showing the auxiliary adjusting element is inserted between a second bracket and the second main adjusting element of the second main adjusting device.

To detach the second main adjusting element 52 from the second bracket 51, with reference to FIGS. 13 and 14, the inserting portion 64 of the auxiliary adjusting element 60 can be inserted into the second crisscross groove 56 of the second shell 53 and is located between the second elastic sheet 513 and the second clutch protrusion 58. The second elastic sheet 513 is pressed by the inserting portion 64 and does not abut against the second shell 53. The second shell 53 can be pressed downwardly for sliding out of the second connecting groove 512 of the second bracket 51. By the same token, the first shell 43 can be detached from the first bracket 41 by the inserting portion 64 of the auxiliary adjusting element 60.

To adjust a position of a bottom edge of the blind 12, the first main adjusting element 42 can be detached from the first bracket 41. With reference to FIGS. 6 to 9, the two engaging portions 621 of the engaging member 62 of the auxiliary adjusting element 60 engage with the first dovetailed portions 45 of the first shell 43 of the first main adjusting element 42. The two positioning portions 622 of the engaging member 62 are inserted into the first crisscross groove 46 to position the auxiliary adjusting element 60 on the first shell 43. Users can grasp the handle 63 and rotate the auxiliary adjusting element 60 for driving the first main adjusting element 42 to rotate. The height adjusting module 20 can be adjusted by the first projection 471 that is rotated by the auxiliary adjusting element 60. The position of the bottom edge of the blind 12 is adjusted by the height adjusting module 20.

To adjust a retracting speed of the blind 12, the second main adjusting element 52 can be detached from the second bracket 51. The retracting speed of the blind 12 is adjusted by the winding module 30. The winding module 30 is adjusted by the rotation of the second main adjusting element 52. In the rotation of the second main adjusting element 52, the two engaging portions 621 of the engaging member 62 of the auxiliary adjusting element 60 engage with the second dovetailed portions 55 and the second shell 53. The auxiliary adjusting element 60 is rotated by users for rotating the second main adjusting element 52 to adjust the torsion of the winding module 30. After the torsion of the winding module 30 is adjusted, the fixing element 70 can be inserted into the fixing recess 32 for preventing the second main adjusting element 52 from rotating. The second main adjusting element 52 with the auxiliary adjusting element 60 is disposed on the second bracket 51. The auxiliary adjusting element 60 is detached from the second main adjusting element 52.

Accordingly, in the adjustment of the height adjusting module 20, a rotating axis of the auxiliary adjusting element 60 and a rotating axis of the first main adjusting element 42 are parallel and not perpendicular to each other. The number of turns of the auxiliary adjusting element 60 is same as the number of turns of the first main adjusting element 42. The auxiliary adjusting element 60 is elongate, so a distance from one end of the handle 63 to the rotating axis of the auxiliary adjusting element 60 is adequate for the auxiliary adjusting element 60 to be easily operated. The adjustment of the height adjusting module 20 is convenient and saves time. By the same token, the adjustment of the winding module 30 is convenient and saves time by the auxiliary adjusting element 60.

In addition, the fixing element 70 can position the second main adjusting element 52 that is adjusted by the auxiliary adjusting element 60. The adjusting convenience of the winding module 30 is increased.

Furthermore, the first main adjusting element 42 is easily detached from the first bracket 41 by the inserting portion 64 of the auxiliary adjusting element 60. The second main adjusting element 52 is easily detached from the second bracket 51 by the inserting portion 64 of the auxiliary adjusting element 60. The auxiliary adjusting element 60 can be applied to adjust the height adjusting module 20 or the winding module 30, assist the first main adjusting element 42 in detaching from the first bracket 41, and assist the second main adjusting element 52 in detaching from the second bracket 51. The practicability of the auxiliary adjusting element 60 is good.

Moreover, the auxiliary adjusting element 60 is made of plastic materials for preventing damage to the first dovetailed portions 45 or the second dovetailed portions 55.

In addition, the auxiliary adjusting element 60 can detachably engage with the first main adjusting element 42 or the second main adjusting element 52. Structures of the first main adjusting element 42 and the second main adjusting element 52 are simplified.

It should be noted that the inventive principles and concepts have been described with reference to a preferred embodiment for the purpose of demonstrating principles and concepts of the invention. Persons of skill in the art will understand how the principles and concepts of the invention can be applied to other embodiments not explicitly described herein. Those skilled in the art will understand that many modifications may be made to the embodiments described herein while still achieving the goals of the invention, and that all such modifications are within the scope of the present disclosure.

What is claimed is:

1. A spring roller blind system comprising:

a roller blind module having a roller tube being hollow and having an outer surface;

a first end; and a second end opposite the first end of the roller tube;

a blind retractably wound on the outer surface of the roller tube and having a top edge fixed on the outer surface of the roller tube;

a height adjusting module inserted into the first end of the roller tube and having a height-adjusting head inserted into the first end of the roller tube and having an outer end surface of the height-adjusting head exposed out of the roller tube; and a height-adjusting hole formed in the height-adjusting head and extending to the outer end surface of the height-adjusting head;

a winding module inserted into the second end of the roller tube and having a winding-adjusting head inserted into the second end of the roller tube and having an outer end surface exposed out of the roller tube; and a fixing recess formed on the outer end surface of the winding-adjusting head;

a first main adjusting device inserted into the height-adjusting head of the height adjusting module and having a first bracket located outside the first end of the roller tube; and a first main adjusting element detachably disposed on the first bracket and inserted into the height-adjusting hole of the height-adjusting head;

a second main adjusting device inserted into the winding-adjusting head of the winding module and having a second bracket located outside the second end of the roller tube; and a second main adjusting element detachably disposed on the second bracket and connected to the winding-adjusting head;

an auxiliary adjusting element configured to be detachably disposed on the first main adjusting element or the second main adjusting element, and having a base having a first surface;

a second surface opposite the first surface of the base;

a first end; and a second end opposite the first end of the base;

an inserting portion formed on the first end of the base;

an engaging member formed on the first surface of the base adjacent to the first end of the base, and having two engaging portions formed on the first surface of the base at a spaced interval; and a handle formed on the second surface of the base adjacent to the second end of the base; and a fixing element selectively inserted into the fixing recess of the winding module for positioning the second main adjusting element.

2. The spring roller blind system as claimed in claim 1, wherein the base of the auxiliary adjusting element has a through hole formed on the first surface of the base and located between the two engaging portions.

3. The spring roller blind system as claimed in claim 1, wherein the fixing element has a plate and an end notch, and the end notch is formed on an end of the plate.

4. The spring roller blind system as claimed in claim 3, wherein the fixing element has two side notches respectively formed on two side surfaces of the plate.

5. The spring roller blind system as claimed in claim 4, wherein the fixing element has an elongated hole formed through the plate, being opposite to the end notch, and located between the two side notches.

6. The spring roller blind system as claimed in claim 1, wherein the first bracket has a first combining surface facing the first end of the roller tube;

a first connecting groove formed in the first combining surface of the first bracket; and a first elastic sheet formed on and protruding from the first combining surface of the first bracket, and inserted into the first connecting groove of the first bracket; and the first main adjusting element has a first shell detachably inserted into the first connecting groove of the first bracket and having a front surface facing the height-adjusting head;

a rear surface opposite the front surface of the first shell and abutting against the first elastic sheet of the first bracket;

an outer edge formed around the rear surface of the first shell;

multiple first dovetailed portions formed on the outer edge of the first shell at spaced intervals; and a first crisscross groove formed on the rear surface of the first shell; and a first adjusting assembly rotatably disposed in the first shell and having a first adjusting rod disposed in the first shell and having two ends;

a first projection formed on one of the two ends of the first adjusting rod and extending out of the front surface of the first shell; and a first clutch protrusion formed on the other end of the first adjusting rod, inserted into the first crisscross groove of the first shell, and abutting against the first elastic sheet of the first bracket; and a first spring disposed in the first shell and having two ends respectively abutting against the first shell and the first adjusting rod.

7. The spring roller blind system as claimed in claim 6, wherein the first projection has an end surface being non-circular.

8. The spring roller blind system as claimed in claim 1, wherein the second bracket has a second combining surface facing the second end of the roller tube;

a second connecting groove formed in the second combining surface of the second bracket; and a second elastic sheet formed on and protruding from the second combining surface of the second bracket, and inserted into the second connecting groove of the second bracket; and the second main adjusting element has a second shell detachably inserted into the second connecting groove of the second bracket and having a front surface facing the winding-adjusting head;

a rear surface opposite the front surface of the second shell and abutting against the second elastic sheet of the second bracket;

an outer edge formed around the rear surface of the second shell;

multiple second dovetailed portions formed on the outer edge of the second shell at spaced intervals; and a second crisscross groove formed on the rear surface of the second shell; and a second adjusting assembly rotatably disposed in the second shell and having a second projection disposed in the second shell, extending out of the front surface of the second shell, and fixed on the winding-adjusting head;

a second clutch protrusion disposed in the second shell around the second projection, inserted into the second crisscross groove of the second shell, and abutting against the second elastic sheet of the second bracket; and a second spring disposed in the second shell and having two ends respectively abutting against the second projection and the second clutch protrusion.

9. The spring roller blind system as claimed in claim 1, wherein the auxiliary adjusting element and the fixing element are made of plastic materials.

10. The spring roller blind system as claimed in claim 2, wherein the auxiliary adjusting element and the fixing element are made of plastic materials.

11. The spring roller blind system as claimed in claim 3, wherein the auxiliary adjusting element and the fixing element are made of plastic materials.

12. The spring roller blind system as claimed in claim 4, wherein the auxiliary adjusting element and the fixing element are made of plastic materials.

13. The spring roller blind system as claimed in claim 5, wherein the auxiliary adjusting element and the fixing element are made of plastic materials.

14. The spring roller blind system as claimed in claim 6, wherein the auxiliary adjusting element and the fixing element are made of plastic materials.

15. The spring roller blind system as claimed in claim 7, wherein the auxiliary adjusting element and the fixing element are made of plastic materials.

16. The spring roller blind system as claimed in claim 8, wherein the auxiliary adjusting element and the fixing element are made of plastic materials.

* * * * *